US005275469A

United States Patent [19]

Geuns et al.

[11] Patent Number: 5,275,469

[45] Date of Patent: Jan. 4, 1994

[54] METHOD OF WORKING COAL SEAMS TO A DEFINED PRESET DEPTH OF CUTTING DURING PLOUGHING WITH A CUTTER

[75] Inventors: Guy Geuns, Wuppertal; Werner Reinelt, Bochum, both of Fed. Rep. of Germany

[73] Assignee: Hermann Hemscheidt Maschinenfabrik GmbH, Wuppertal, Fed. Rep. of Germany

[21] Appl. No.: 890,272

[22] Filed: May 29, 1992

[30] Foreign Application Priority Data

May 30, 1991 [DE] Fed. Rep. of Germany ..... 4117731
May 30, 1991 [DE] Fed. Rep. of Germany ..... 4117732

[51] Int. Cl.[5] ..... E21D 23/14; E21C 35/14
[52] U.S. Cl. ..... 299/1.7; 405/302
[58] Field of Search ..... 299/1.7, 32; 405/302

[56] References Cited

U.S. PATENT DOCUMENTS 3,246,730 4/1966 Bolton et al. ..... 405/302 X
4,134,270 1/1979 Small et al. ..... 405/302
5,137,336 8/1992 Merten ..... 299/1.7

FOREIGN PATENT DOCUMENTS 1095543 12/1967 United Kingdom ..... 299/1.7

*Primary Examiner*—David J. Bagnell
*Attorney, Agent, or Firm*—Keck, Mahin & Cate

[57] ABSTRACT

A method of working coal seams to a defined preset cutting depth during ploughing with a cutter, a face conveyor moving along a face behind the cutter being advanced by the defined preset cutting depth and this advance being made by extension of self-advancing cylinders pivotally attached at one end to the face conveyor and at the other end to face supports disposed parallel to the face conveyor. The advance is controlled in dependence upon the piston stroke of the self-advancing cylinders, carried out in dependence upon individually defined partial strokes corresponding to the preset depth of cutting. After a predetermined maximum total piston stroke has been reached, the face support connected to the respective self-advancing cylinder is automatically disengaged, advanced by the maximum total piston stroke and then re-set (self-advancing process). The length of the partial strokes corresponding to the preset depth of cutting is increased by an amount to compensate an average mechanical clearance at the pivot points of the self-advancing cylinders.

8 Claims, 6 Drawing Sheets

Figure 1:
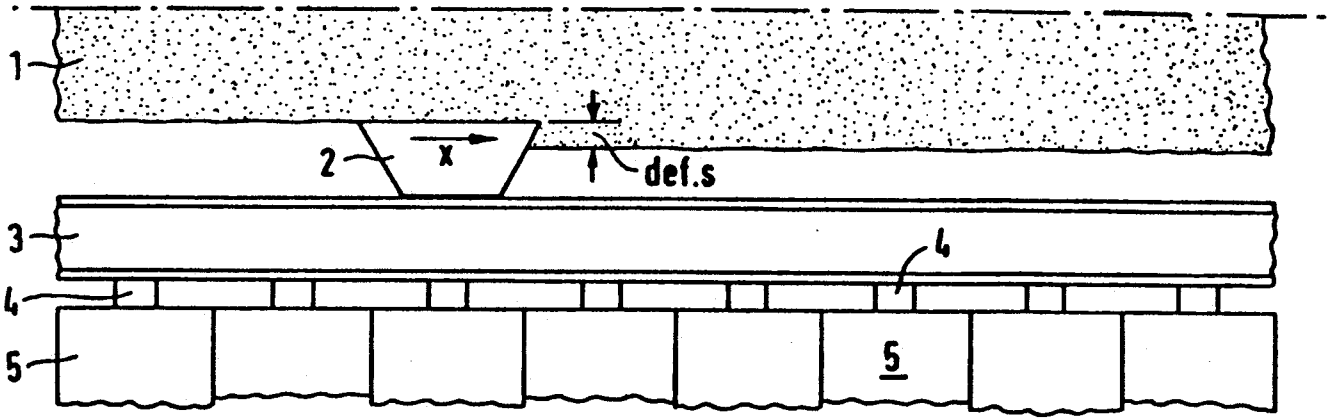

METHOD OF WORKING COAL SEAMS TO A DEFINED PRESET DEPTH OF CUTTING DURING PLOUGHING WITH A CUTTER

The present invention relates to a method of working coal seams to a defined preset cutting depth during ploughing with a cutter, a face conveyor moving along a face behind the cutter being advanced by the defined preset cutting depth and this advance being made by extension of self-advancing cylinders pivotally attached at one end to the face conveyor and at the other end to face supports disposed parallel to the face conveyor.

In coal seams where the coal is difficult or very difficult to cut, the use of cutters is frequently seriously affected by jamming, in spite of the cutter being one of high installed power. This results in uncontrolled overshooting of the set depth of cutting, with the result that the cutter jams in the coal face. This is avoided by the aforementioned process, where the cutter is used at a defined preset depth of cutting. Hitherto, it has thus been possible to maintain an exact cutting depth along the entire face. However, the coal face does not have uniform composition. This has resulted in jamming of the cutter, with serious effects on its operation and output.

An aim of the present invention is to improve the aforementioned process so that, irrespective of the conditions, the coal in the face can be continuously mined to a defined cutting depth, and with the cutter jamming less frequently.

Accordingly, the present invention is directed to a method as set out in the opening paragraph of the present specification, in which the advance is controlled in dependence upon the piston stroke of the self-advancing cylinder, which is carried out in individual defined partial strokes corresponding to the preset depth of cutting and using distance-measuring signals generated at each partial stroke, and after a predetermined maximum total piston stroke has been reached, the support frame connected to each self-advancing cylinder is automatically disengaged, moved forward to the maximum total piston stroke and then re-set (self-advancing process).

The method according to the present invention ensures that the cutter cuts to a constant depth even though, owing to widely different conditions in the face and mechanical differences between individual face supports, the individual face supports are at varying distances from the conveyor after a short period of operation. The present invention therefore prevents the cutter from jamming and keeps the longwall conveyor in the set position. Cutting in both directions or in sections is possible at any time.

Advantageously, the self-advancing cylinders are controlled in that the sum of the partial strokes of the cylinders in adjacent face supports is compared and if two face supports simultaneously reach the maximum total stroke of the self-advancing cylinders, the two adjacent face supports are advanced in succession in accordance with a predetermined sequence.

Preferably, the sum of the partial strokes of the self-advancing cylinders of the face supports is continuously monitored and recorded in a central computer unit and, especially in the event of the absence of a distance-measuring signal corresponding to a partial stroke of one or more self-advancing cylinders, a fault signal is generated and/or the corresponding self-advancing cylinder is identified on a display.

In a preferred embodiment, an average sum corresponding to the average distance advanced by the face supports is calculated from the sum of the partial strokes of the self-advancing cylinders, and if the sum of the partial strokes of a cylinder of a face support deviates from the average sum a fault is reported.

Advantageously, the piston stroke of the self-advancing cylinders corresponds to the piston stroke of a pushing ram of a drive unit of the face supports and cutter disposed in the gallery, and after a predetermined maximum stroke of the pushing ram has been reached, the entire pushing ram is advanced with adaptation to the maximum total piston stroke of the self-advancing cylinders.

With the method of the present invention it has been found that, after a certain time and repeated advance of the face supports, the conveyor is put in a sloping position, with the result that the coal is cut at a reduced depth in some places, or in extreme cases the cutter may run idly. It is therefore a further aim of the present invention to avoid the aforementioned disadvantage so that the conveyor is not put in a sloping position at any time during the mining operation.

To this end, advantageously the length of the partial strokes corresponding to the preset depth of cutting is increased by an amount to compensate an average mechanical clearance at the pivot joints of the self-advancing cylinders.

This further advantageous feature is based on the discovery that a mechanical clearance amounting to, for example, 60 to 80 mm occurs at the pivot points of the self-advancing cylinders at the conveyor and at the runners, with the result that the preset cutting depth of the cutter no longer corresponds to the individual partial stroke of the self-advancing cylinders but is reduced by the mechanical clearance. This results in the previously-mentioned disadvantages.

At certain time intervals, the distance actually travelled by the individual face supports as a result of the partial strokes is measured and the distances are compared. It is thus possible for the amount of compensation required by the partial strokes of the self-advancing cylinders to be re-calculated at certain time intervals for the individual face supports. The clearance may be increased by mechanical wear, or dirt or the like may occur at the pivot points and reduce the mechanical clearance, necessitating continuous monitoring and subsequent adjustment of the compensation of clearance according to the present invention.

Between the individual channel components of the conveyor there is also a clearance, resulting in a maximum deviation of 3° in the angle between the individual channel components, and consequently the distance resulting from this angular deviation determined the maximum possible variations in the distance advanced by the individual face supports.

This advantageous feature of the present invention ensures that the cutting depth is always constant, even though, as a result of differences in the longwall face and mechanical differences between the individual face supports, the individual supports will be at varying differences from the conveyor after a short period of operation. The present invention therefore prevents jamming of the cutter and maintains the face conveyor in the set position. Cutting in both directions or in portions is possible at any time.

Preferably, at certain intervals the distance actually travelled by the individual face supports as a result of the partial strokes is measured and the distances travelled by individual face supports is compared.

In a preferred embodiment, if the distance actually travelled by the individual face supports deviates by a predetermined maximum permissible value from the distance calculated in accordance with the number of partial strokes, the amount of compensation of the clearance of the stroke for the respective self-advancing cylinder is reduced or increased.

The present invention will be explained in detail with reference to the examples thereof shown in the accompanying diagrammatic drawings, in which FIGS. 1 to 4 show a flow chart of four successive operating stages of a method according to the present invention;

FIGS. 5 to 8 show a flow chart of four successive operating stages of other features of the method according to the present invention which correspond to the flow chart illustrated in FIGS. 1 to 4; and FIGS. 9 to 12 show a flow chart of four successive operating stages of another embodiment of the method according to the present invention which correspond to the flow chart illustrated in FIGS. 1 to 4.

FIGS. 1 to 12 diagrammatically show the working layout in a longwall face. A cutter 2 is driven along a coal face 1, that is along a face conveyor 3 disposed parallel to the surface of a coal face 1. The conveyor 3 is moved forward by self-advancing cylinders 4, pivotally attached at one end to the conveyor 3 and at the other end to face supports 5 disposed parallel to the conveyor 3. The face supports 5 can for example be two-prop shield-type supports, either with a rigid continuous roof bar or with an adjustable sliding bar.

Figure 2:
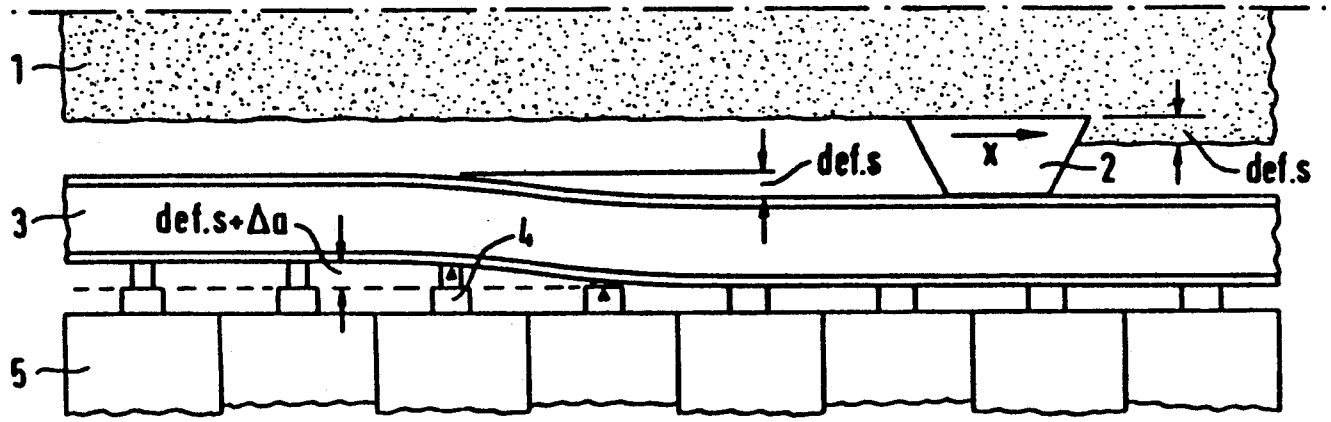
Figure 3:
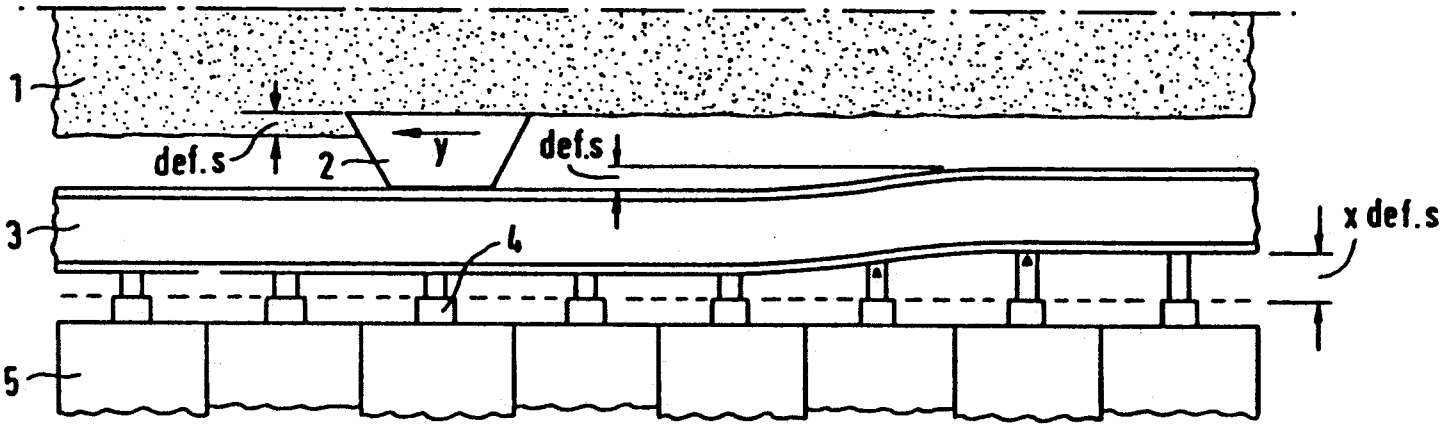
Figure 4:
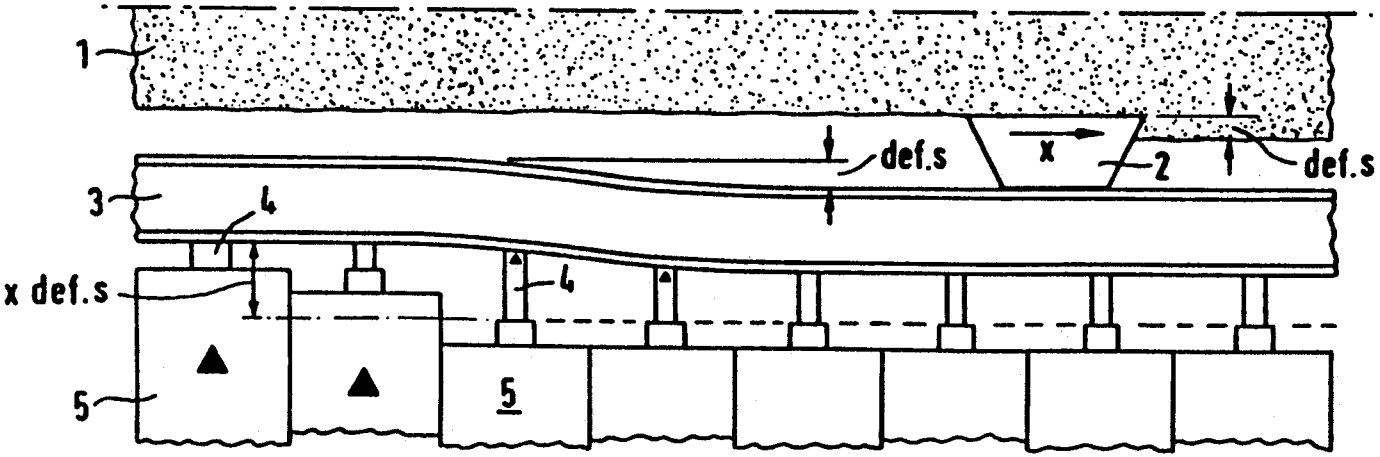
Figure 5:
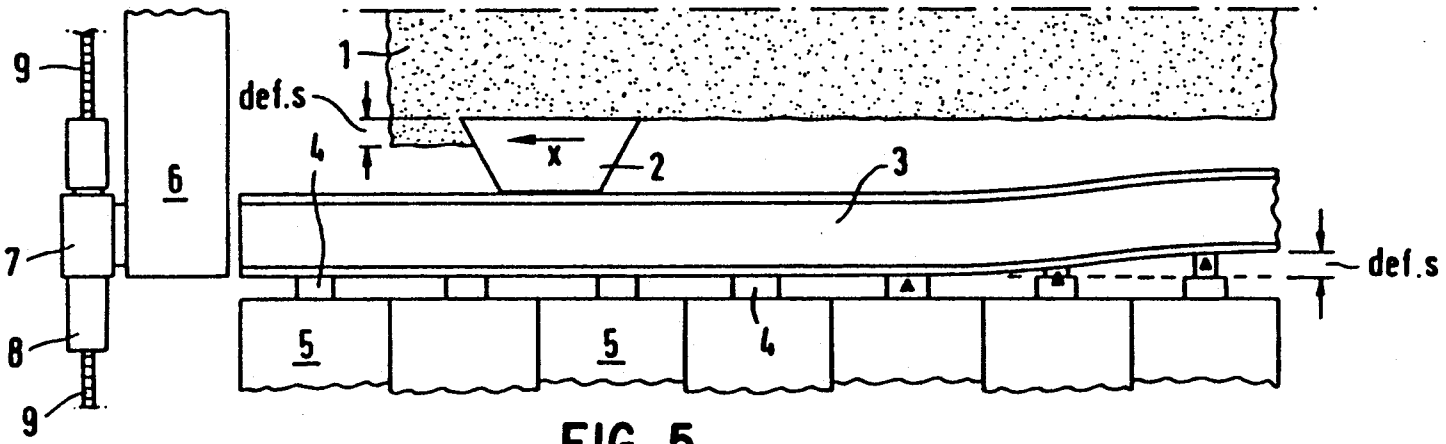
Figure 6:
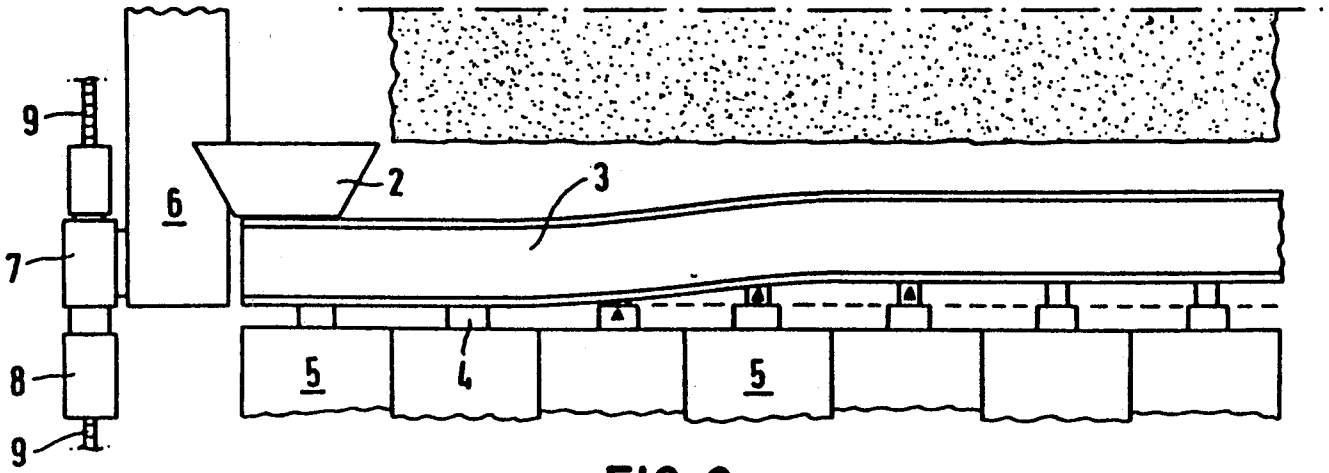
Figure 7:
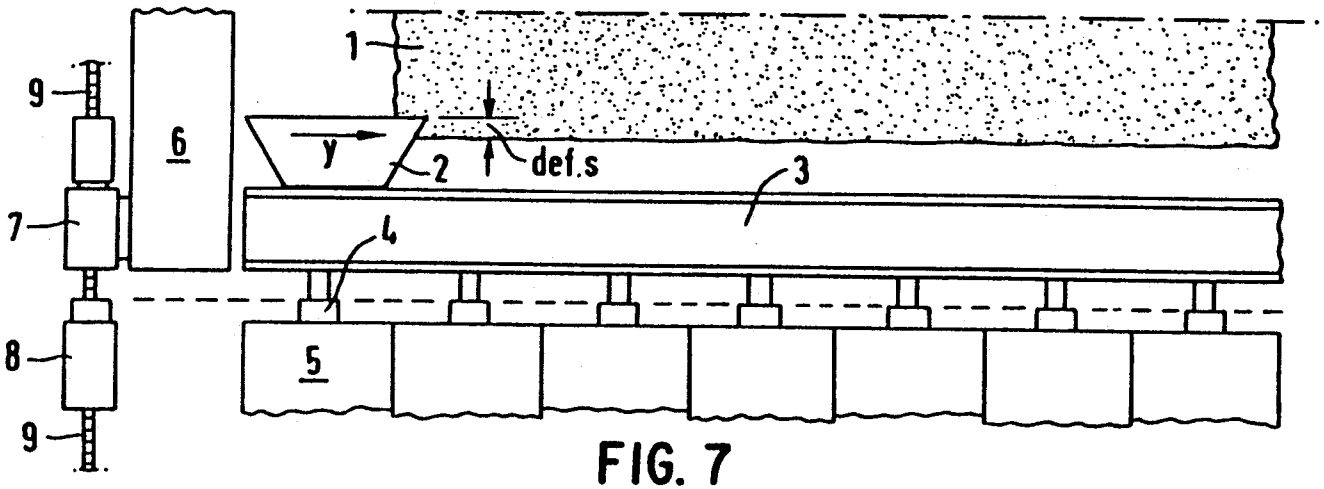
Figure 8:
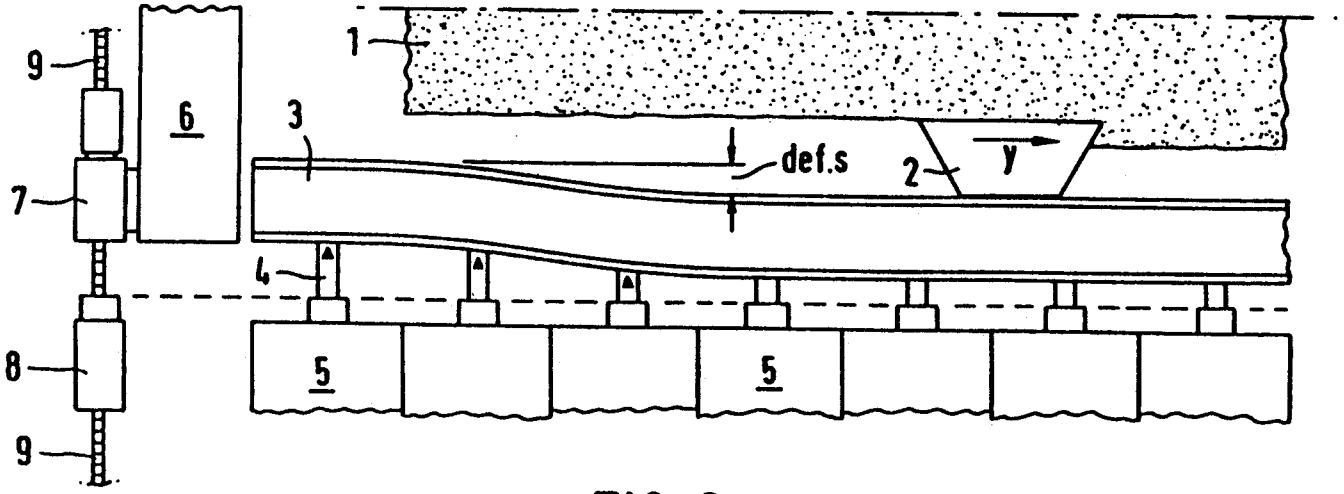

FIG. 1 shows the first phase of the process according to the present invention, when all the face supports 5 are set and the self-advancing cylinders 4 are in the starting position. The cutting depth of the cutter 2 is def.s. The cutter 2 is driven in the direction of the arrow x. FIG. 2 shows the second phase of the method according to the present invention, in which the self-advancing cylinders 4 of the face supports 5 which the cutter 2 has already passed have now been extended by the defined preset cutting depth def.s, and the face conveyor 3 has simultaneously been moved forward by the same defined amount. According to the present invention, the advance is controlled in dependence upon the piston stroke of the self-advancing cylinders 4, carried out in individual defined partial strokes, using distance-measuring signals generated at each partial stroke, because distance sensors are disposed on the self-advancing cylinders, and after each partial stroke they generate a distance-measuring signal corresponding to the defined preset depth of cutting def.s. FIG. 3 shows the third phase of the method according to the present invention, in which the direction of motion of the cutter 2 has been reversed as per the arrow y. In FIG. 3, the self-advancing cylinders 4 which the cutter 2 has passed have been extended again by an amount equal to the defined preset depth of cutting, that is to say they have now been extended by 2×def.s, starting from the first reversal of direction of the cutter 2. According to another feature of the present invention, after a predetermined maximum total piston stroke has been reached, the face support 5 connected to the respective self-advancing cylinder 4 is automatically drawn, moved forward by the maximum total piston stroke and then re-set (self-advancing process). This process is shown in FIG. 4, where the two face supports 5 at the left-hand edge of FIG. 4 have already carried out this advancing process or are in the act of doing so. According to another feature, the self-advancing cylinders 4 are controlled such that the sum of the partial strokes of the cylinders in adjacent face supports is compared and, if two face supports 5 simultaneously reach the maximum total stroke of the self-advancing cylinder 4, the two adjacent face supports 5 are advanced in succession in accordance with a preferred sequence.

According to the present invention, therefore, the shield-type supports 5 monitor themselves, ensuring that no two adjacent face supports 5 advance simultaneously. In principle, according to the present invention, the advance is made firstly by that face support 5 which first reaches the maximum stroke of its self-advancing cylinder. According to another feature of the invention, the sum of the partial strokes of the self-advancing cylinders 4 of the face supports 5 is continuously measured and recorded in a central computer unit and in the event of absence of a distance-measuring signal corresponding to a partial stroke of one or more of the self-advancing cylinders 4, a fault signal is generated and/or a display device indicates the self-advancing cylinder for which no distance-measuring signal has been generated. This automatic check prevents a face support 5 from remaining behind the other face supports 5 and thus preventing an orderly advance of the conveyor 3. Advantageously also according to the present invention, an average sum corresponding to the average distance advanced by the face support 5 is calculated from the sum of the partial strokes of the individual self-advancing cylinders 4 and, if the sum of the partial strokes of a cylinder 4 of a face support 5 deviates from the average sum, a fault is reported. This also results in continuous monitoring of the state of the individual face supports 5 and ensures that faulty operation, for example if the partial strokes of the self-advancing cylinders 4 are too small in regard of some face supports 5, are promptly recognised and can be manually corrected.

To ensure parallel working in the cutter region, according to another feature of the present invention, the instantaneous current consumption of the cutter drive is recorded by a fast analog signal processor and compared with a predetermined average current consumption for operating the cutter. 2 for cutting to the defined thickness. By this means, if the measured value deviates indicating increased current consumption, a possible jamming of the cutter 2 with up to eight shield-type supports 5 can be calculated in advance, so that the advance of the conveyor can be reduced by a predetermined value in the anticipated jammed area and thus jamming can be prevented.

FIGS. 5 to 8 are block diagrams showing other features of the method according to the present invention. The drawings, which supplement Figures to 4, likewise diagrammatically show the working layout in the gallery, which contains a face conveyor 6 and a drive 7 for the conveyor 3 or for the face conveyor 6. As the sketch also shows, the drive 7 is moved forward by a pushing ram 8, which is pivotally attached at one end to the drive and at the other end to a rail arrangement 9 secured to the floor of the gallery and formed with spaced-apart lock-in positions. In the method according to the present invention, to ensure continuous working, the advance of the drive unit 7 is incorporated in the process for working the coal seam to a defined preset depth of cutting, that is to say, the advance of the drive unit 7 is adapted to the advance of the conveyor 3 and carried out in dependence upon the piston stroke of the self-advancing cylinders 4 of the face supports 5. To this end, as before, the pushing ram 8 of the drive unit 7 is equipped with a distance sensor and an additional control device, similar to that in the individual face supports. In FIGS. 5 to 8, the pushing ram 8 advances along the rail arrangement 9, in contrast to the manner in which the face support 5 advances in FIGS. 1 to 4. This additional inventive feature ensures that right at the beginning of the coal face, the working front is given a shape corresponding to that of the working front inside the face. In other respects, as regards the advance of the support frame and conveyor and the position of the self-advancing cylinders, the diagrams correspond to the process explained with reference to FIGS. 1 to 4.

FIGS. 9 to 12 diagrammatically show the working layout in a longwall face in a further embodiment of the present invention in the same manner as described with regard to FIGS. 1 to 4.

Figure 9:
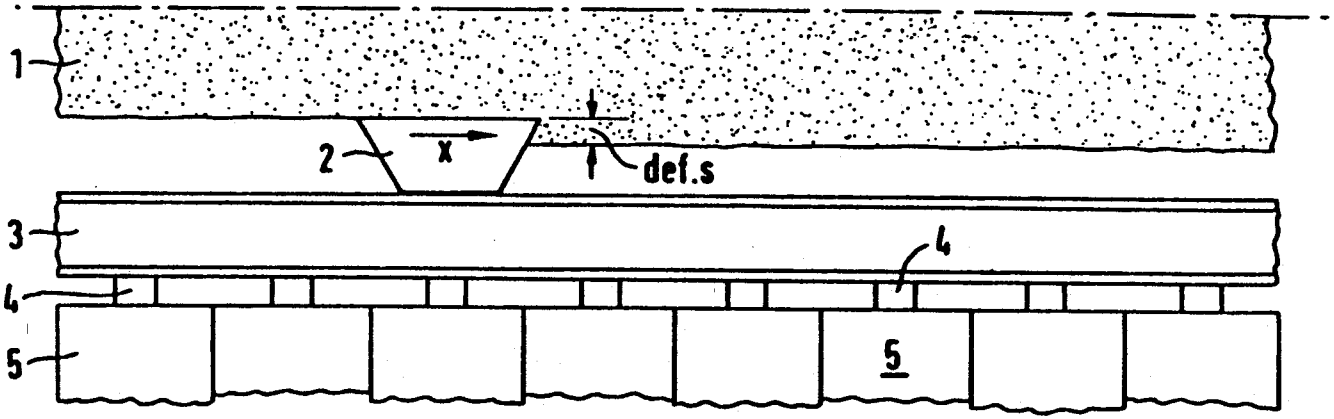
Figure 10:
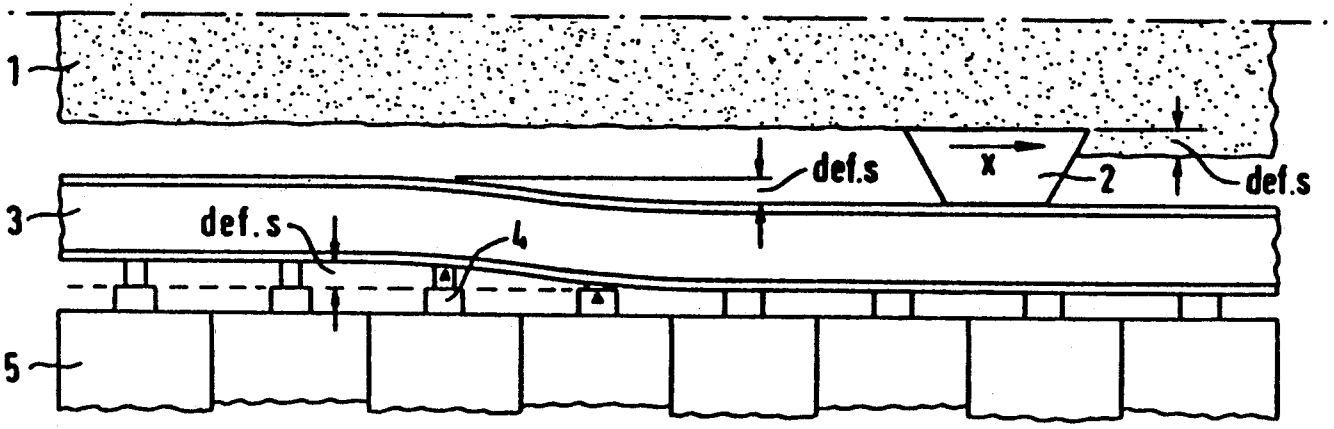
Figure 11:
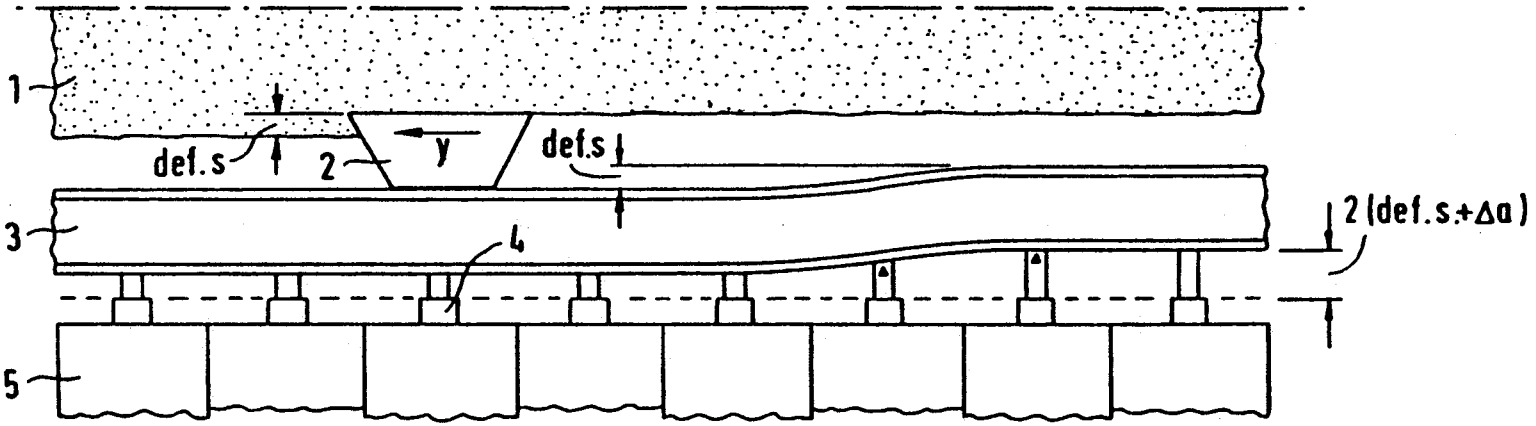
Figure 12:
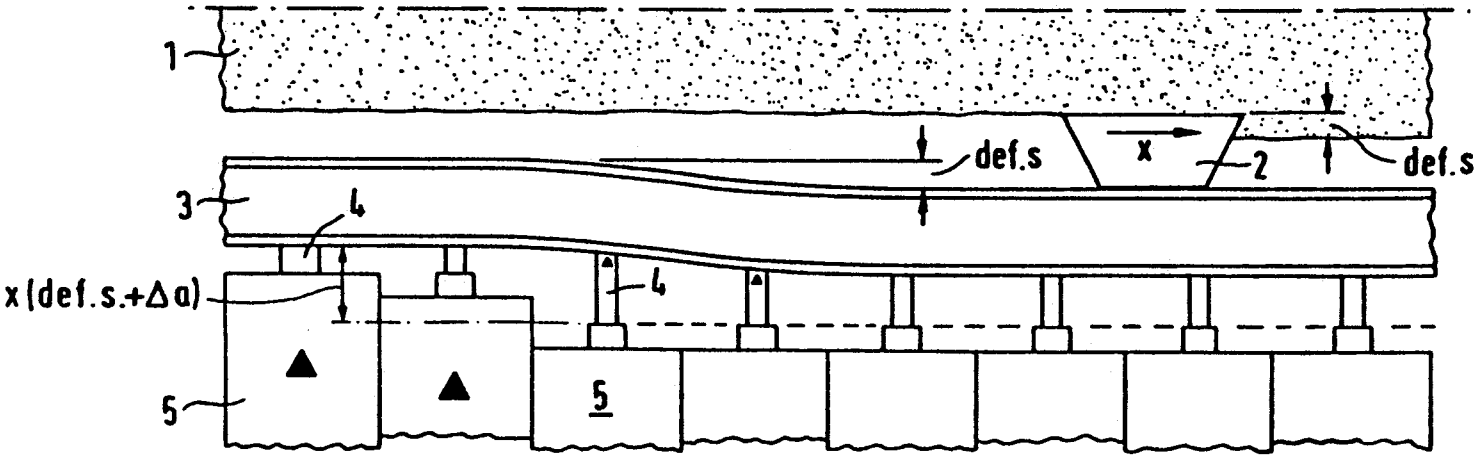

FIG. 9 shows the first phase of another embodiment of the process according to the present invention, where all face supports 5 are set and the self-advancing cylinders 4 are in the starting position. The cutter 2 has a cutting depth def.s. The cutter 2 is driven in the direction of the arrow x. FIG. 10 shows the second phase of this embodiment of the process according to the present invention; as shown, the self-advancing cylinders 4 of those support frames 5 which the cutter 2 has already passed have now been extended by the defined preset depth of cutting def.s plus a compensating amount $\Delta a$. $\Delta a$ is the amount compensating a mechanical clearance, mainly occurring at the pivot points of the self-advancing cylinder 4, with the result that the advance of the conveyor 3 and consequently the preset cutting depth of the cutter 2 is less than the distance corresponding to the individual partial stroke. According to this embodiment of the present invention, the distance covered by each partial stroke is increased by the amount $\Delta a$ corresponding to the existing mechanical clearance, thus ensuring that the conveyor 3 always travels the distance def.s and thus maintains the preset cutting depth def.s. According to another feature, the advance is controlled in dependence upon the piston stroke of the self-advancing cylinders 4, carried out in individual defined partial strokes, and via distance signals generated at each partial stroke, that is to say distance sensors are disposed on the self-advancing cylinders 4 and generate a distance signal after each partial stroke. FIG. 11 shows the third phase of this embodiment of the process according to the present invention, in which the direction of motion of the cutter 2 is reversed in the direction of the arrow y. In FIG. 11 as before, those self-advancing cylinders 4 which the cutter 2 has passed are now extended again by an amount equal to the defined preset cutting depth plus an amount compensating the clearance, so that the cylinders 4, starting from a first change of direction of the cutter 2, have now been extended by the amount $2\times(\text{def.s} + \Delta a)$. According to another feature of the present invention, after reaching a predetermined maximum total piston stroke, the face support 5 connected to each self-advancing cylinder 4 is automatically drawn, advanced by the maximum total piston stroke and then re-set (the self-advancing process). This process is shown in FIG. 12, where the two face supports 5 at the left-hand edge of FIG. 12 have already completed the advance or are in the process of advance. According to another feature, the self-advancing cylinders 4 are controlled so that the sum of the partial strokes of the self-advancing cylinders 4 of adjacent face supports 5 is compared and, if two adjacent supports 5 simultaneously reach the maximum total stroke of the self-advancing cylinders 4, the two adjacent face supports 5 are made to advance in succession in a predetermined sequence (algorithm). The shield-type supports 5 therefore monitor one another, thus preventing any two adjacent face supports 5 advancing simultaneously. In principle, however, the first advance is made by the face support 5 which first reaches the maximum stroke of its self-advancing cylinder 4. According to another feature, the sum of the partial strokes of the self-advancing cylinders 4 of the face supports 5 is continuously measured and recorded in a central computer unit and, in the event of the absence of a distance signal corresponding to a partial stroke of one or more self-advancing cylinders 4, a fault signal is generated and/or the self-advancing cylinder 4 for which no distance signal has been generated, is displayed. This automatic check prevents any face support 5 being left behind by the other face supports 5, which would hinder the regular advance of the conveyor 3. Advantageously also according to the present invention, the sum of the partial strokes of the individual self-advancing cylinders 4 is used to calculate an average sum corresponding to an average distance advanced by the face supports 5, and if the sum of the partial strokes of a self-advancing cylinder 4 of a face support 5 deviates from the average sum, a fault is reported as before. This is another means of continuously monitoring the state of the individual face supports 5 and ensures that faulty operating, for example if the partial strokes of the self-advancing cylinders 4 of some face supports 5 are too small, can be promptly recognised in order to make manual adjustments.

According to the present invention, the distance actually travelled by the individual face supports 5 as a result of the individual strokes is measured and the individual values are compared, and consequently the comparison can be used to determine an average value and, in the event of deviations from this average value by some of the face supports 5, the amount of compensation for clearance can be corrected by adaptation to the average value. In addition, the distance actually travelled by the individual face supports 5, corresponding to the number of partial strokes, can be calculated and this distance can be compared with the calculated distance. If a deviation from the actual distance is found, that is to say above or below the calculated distance, the amount of compensation of clearance of the stroke distance can be correspondingly reduced or increased. By means of the present invention, therefore, the compensation of clearance can be used to limit the slope of the conveyor 3 to a given amount, not to be exceeded, and also to ensure a constant value for the preset cutting depth of the stroke during the entire working time.

We claim:

1. A method of working coal seams using a ploughing cutter and self-advancing roof supports, which comprises:

(a) cutting coal at a coal face to a defined preset depth by ploughing with the cutter, (b) advancing a face conveyor which extends along the coal face behind the cutter through a distance equal to the defined preset cutting depth, such advance of the face conveyor being effected by the extension of self-advancing piston cylinders pivotally connected at one end to the face conveyor and at the other end to roof supports disposed parallel to the face conveyor, (c) controlling the advance of the face conveyor in dependence on the piston strokes of the respective self-advancing cylinders by carrying out the piston stroke of each cylinder in a plurality of individual defined partial strokes corresponding to the preset depth of cutting and using distance-measuring signals generated at each partial stroke, (d) automatically disengaging the roof support from its respective self-advancing cylinder after the predetermined maximum total piston stroke has been reached, and (e) moving the roof support forwards through a distance equal to the maximum total piston stroke and re-setting the roof support.

2. A method according to claim 1 which comprises comparing the sum of the partial strokes of the cylinders of adjacent roof supports and, if two roof supports simultaneously reach the maximum total stroke of their self-advancing cylinders, advancing the two adjacent roof supports in succession in accordance with a predetermined sequence.

3. A method according to claim 1 which comprises continuously monitoring the sum of the partial strokes of the self-advancing cylinders of the roof supports, recording the results in a central computer unit, and, in the event of the absence of a distance-measuring signal corresponding to a partial stroke of at least one self-advancing cylinder, generating a fault signal and/or identifying the corresponding self-advancing cylinder on a display.

4. A method according to claim 1 which comprises calculating an average sum corresponding to the average distance advanced by the roof supports from the sum of the partial strokes of the self-advancing cylinders and, if the sum of the partial strokes of a cylinder of a roof support deviates from the average sum, reporting the fault.

5. A method according to claim 1 which comprises matching the piston stroke of the self-advancing cylinders to the piston stroke of a pushing ram of a drive unit for the roof supports and cutter, and, after a predetermined maximum stroke of the pushing ram has been reached, advancing the entire pushing ram with adaptation to the maximum total piston stroke of the self-advancing cylinders.

6. A method according to claim 1 which comprises increasing the length of the partial strokes corresponding to the preset depth of cutting by an amount to compensate an average mechanical clearance at the pivotal connections of the self-advancing cylinders.

7. A method according to clam 1 which comprises measuring the distance actually travelled by the individual roof supports as a result of the partial strokes and comparing the measured distances with the distances travelled by individual roof supports.

8. A method according to claim 1 which comprises reducing or increasing the amount of compensation for the clearance of the stroke of a respective self-advancing cylinder if the distance actually travelled by the individual roof supports deviates by a predetermined maximum permissible value from the distance calculated in accordance with the number of partial strokes.

* * * * *